US007957656B2

(12) United States Patent
Moore et al.

(10) Patent No.: US 7,957,656 B2
(45) Date of Patent: Jun. 7, 2011

(54) APPARATUS, METHOD AND SYSTEM FOR FEEDFORWARD OF SHEET ELECTROSTATIC TACKING PARAMETERS TO IMAGE TRANSFER SUBSYSTEM IN IMAGE TRANSFER APPARATUS

(75) Inventors: Steven R. Moore, Pittsford, NY (US); Paul J. DeGruchy, Hilton, NY (US); Peter J. Knausdorf, Henrietta, NY (US); Gerald M. Fletcher, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 242 days.

(21) Appl. No.: 12/329,080

(22) Filed: Dec. 5, 2008

(65) Prior Publication Data

US 2010/0142982 A1 Jun. 10, 2010

(51) Int. Cl.
*G03G 15/00* (2006.01)

(52) U.S. Cl. ..... 399/45; 399/388

(58) Field of Classification Search ..... 399/45, 399/66, 296, 312, 313, 303, 388, 389, 390
See application file for complete search history.

(56) References Cited

U.S. PATENT DOCUMENTS

| | | | | |
|---|---|---|---|---|
| 5,361,125 | A * | 11/1994 | Fletcher | |
| 5,717,980 | A * | 2/1998 | Oka et al. | 399/66 |
| 5,812,920 | A * | 9/1998 | Mizude et al. | 399/388 |
| 6,029,022 | A * | 2/2000 | Takase | 399/66 |
| 6,721,515 | B2 * | 4/2004 | Kuribayashi et al. | 399/66 |
| 6,766,123 | B2 * | 7/2004 | Ebihara et al. | 399/66 |
| 6,963,702 | B2 * | 11/2005 | Fletcher et al. | 399/66 |
| 7,346,287 | B2 * | 3/2008 | Ogiyama et al. | 399/66 |

FOREIGN PATENT DOCUMENTS

| | | | |
|---|---|---|---|
| JP | 06075483 | A * | 3/1994 |
| JP | 07005771 | A * | 1/1995 |
| JP | 07175350 | A * | 7/1995 |
| JP | 08185102 | A * | 7/1996 |
| JP | 09212000 | A * | 8/1997 |
| JP | 2004145002 | A * | 5/2004 |

* cited by examiner

*Primary Examiner* — Susan S Lee
(74) *Attorney, Agent, or Firm* — Oliff & Berridge, PLC

(57) ABSTRACT

A toner image transfer assembly has a tacking assembly, an image transfer assembly, and a media transport assembly. The tacking assembly senses critical properties of media while electrostatically tacking media to a transport device. The tacking assembly forwards data corresponding to the sensed electrical properties to the image transfer assembly so that the image transfer assembly anticipates the electrical properties of an approaching media type.

19 Claims, 4 Drawing Sheets

APPARATUS, METHOD AND SYSTEM FOR FEEDFORWARD OF SHEET ELECTROSTATIC TACKING PARAMETERS TO IMAGE TRANSFER SUBSYSTEM IN IMAGE TRANSFER APPARATUS

BACKGROUND

The exemplary embodiments are directed to an electrostatic image transfer apparatus. More specifically, the exemplary embodiments are directed to an apparatus, a method and a system for feedforward of sheet electrostatic tacking parameters to an image transfer assembly.

Electrostatic imaging and printing processes are comprised of several distinct stages. These stages may generally be described as (1) charging, (2) imaging, (3) exposing, (4) developing, (5) transferring, (6) fusing and (7) cleaning. In the charging stage, uniform electrical charges are deposited on a charge retentive surface, such as, for example, a surface of a photoreceptor, so as to electrostatically sensitize the surface. Imaging converts an original, or digital image into a projected image on the surface of the photoreceptor and the image is then exposed upon the sensitized photoreceptor surface. An electrostatic latent image is thus recorded on the photoreceptor surface corresponding to the original, or digital image.

Development of the electrostatic latent image occurs when charged toner particles are brought into contact with this electrostatic latent image. The charged toner particles are attracted to either the charged or discharged regions of the photoreceptor surface that correspond to the electrostatic latent image, depending on whether a charged area development (CAD) or a discharged area development (DAD, more common) is being employed.

In the case of a single step transfer process, the photoreceptor surface with the electrostatically attracted toner particles is then brought into contact with an image receiving surface, i.e., paper or other similar substrate; Toner particles are imparted to the image receiving surface by a transferring process wherein an electrostatic field attracts the toner particles toward the image receiving surface, causing the toner particles to adhere to the image receiving surface rather than to the photoreceptor. Toner particles then fuse into the image receiving surface by a process of melting and/or pressing. The process is completed when the remaining toner particles are removed or cleaned from the photoreceptor surface.

An objective of the transferring process is to ensure that all of the toner is removed from the photoreceptor surface onto the paper or other suitable media. To accomplish this objective, it is known in the art that an electric field, or transfer field, is built at the point at which the media passes the photoreceptor for transfer as it is carried by a belt through the image transfer apparatus. As the media enters the transfer nip, a roll that may be electrically biased applies pressure to the media in a direction opposite of pressure applied by the photoreceptor to the media to enhance toner transfer to the media. The transfer field assists in applying a net force on the toner particles that causes the toner particles to move from the photoreceptor to the paper.

SUMMARY

It is increasingly difficult, however, to achieve optimal toner particle transfer at the transfer nip due to a widening variety of media types, each having unique dielectric properties. The dielectric properties of media may influence the shape and intensity of the transfer field.

It is known that transfer nip settings may be adjusted prior to the arrival of a specified media based upon system inputs including user supplied information about the media composition (thickness, media type), nominal media size, and environmental factors (temperature, relative humidity). These system inputs may then be used to determine transfer nip settings for the specified media. However, the specific media dielectric properties may vary substantially due to individual sheet moisture content variation, sheet size and thickness tolerances, variation in the sheet constituent materials, and user input error. A need therefore exists in the art for manipulating the electric field at the transfer nip, i.e. the transfer field, to compensate for the unique dielectric properties of varied media fed through an image transfer apparatus. Further, there is a need in the image transfer art for determining dielectric properties of media carried by a transfer belt before passage through the transfer nip so as to accommodate optimal toner particle transfer to media regardless of type by accounting for the dielectric properties of a particular sheet as it approaches the transfer nip, and adjusting the transfer field accordingly.

It would be advantageous to provide an image transfer apparatus that enhances or improves the quality of prints, reduces the number of components and therefore cost of manufacture, and expands the overall capability of the image transfer apparatus by accommodating varying media types. To address or accomplish these advantages, advantages described below and/or other advantages, the exemplary embodiments may include a toner image transfer apparatus having a tacking assembly, an image transfer assembly, and a media transfer assembly interposing the tacking assembly and the image transfer assembly. The image transfer assembly is capable of electrostatically transferring an image to a media. The media transfer assembly is constructed and arranged to accommodate the carriage of media from the tacking assembly to the image transfer assembly.

The tacking assembly is constructed to electrostatically tack media to e.g., a belt of the media transfer assembly. The tacking assembly may be constructed to sense critical electrical properties of the media. Specifically, a sheet may be first electrostatically tacked to a belt which then escorts the sheet to the image transfer assembly. The tacking assembly senses critical media electrical properties as the sheet is being tacked to the belt, prior to toner transfer. Data corresponding to the sensed electrical properties may be fed forward to the image transfer assembly before passage of the sheet through the image transfer assembly. The feedforward of electrostatic tacking parameters allows for fine-tuning of the transfer field at the transfer nip of the image transfer assembly during toner particle transfer from the photoreceptor to the sheet.

Exemplary embodiments are described herein with respect to architecture of graphic or electrophotographic print engines. However, it is envisioned that any imaging devices that may incorporate the features of the electrostatic imaging apparatus described herein are encompassed by the scope and spirit of the exemplary embodiments.

EMBODIMENTS

Figure 1:
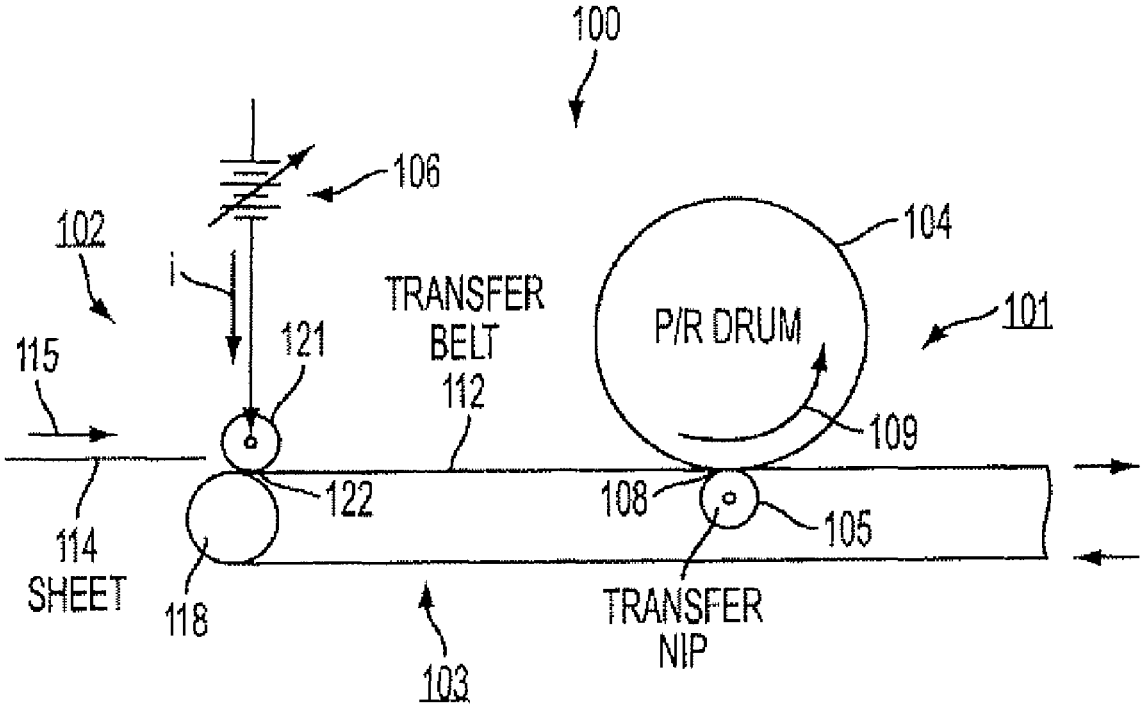
FIG. 1 is a front view of an imaging device of an exemplary embodiment.

The exemplary embodiments are intended to cover all alternatives, modifications and equivalents as may be included within the spirit and scope of the devices, methods and systems as defined herein.

For an understanding of the apparatus, method and system for feedforward of sheet electrostatic tacking parameters, reference is made to the drawings. In the drawings, like reference numerals have been used throughout to designate similar or identical elements. The drawings depict various embodiments of illustrative electrophotographic printing machines incorporating the features of the exemplary embodiments therein. As shown, the drawings schematically depict the various components of electrophotographic printing machines that have the various features. In as much as the art of electrophotographic printing is well known, the various processing stations employed in the printing machines will be schematically shown herein and their operation described with reference thereto.

Referring now to FIG. 1, one embodiment of an apparatus for feedforward of sheet electrostatic tacking parameters to an image transfer subsystem may include an image transfer apparatus 100 having a toner image transfer assembly 101, a tacking assembly 102, and a media transfer assembly 103.

Toner image transfer assembly 101 may include a photoreceptor 104 and a transfer nip roll 105 that together define a transfer nip 108. Photoreceptor 104 is illustrated in the shape of a roll. However, photoreceptor 104 may alternatively be a belt, in any shape, or constitute any known or later developed device that may be electrostatically charged so that it may carry and transfer a toner image or an electrostatic image. In the embodiment of FIG. 1, the photoreceptor 104 is mounted rotatably on an axis (not shown) such that the photoreceptor rotates in the direction of arrow 109.

Media transfer assembly 103 may include a transfer belt 112 constructed to carry a media sheet 114. Transfer belt 112 may be supported by one or more transfer rolls 118. Transfer belt 112 may be constructed to carry a media sheet 114 from tacking assembly 102 through transfer nip 108 in the direction of arrow 115. Transfer nip roll 105 may be one of transfer rolls 118. Transfer belt 112 may be constructed to translate past transfer nip roll 105 to synchronously bring the media sheet 114 into contact with photoreceptor 104 at transfer nip 108 and the toner image retained thereon. In an exemplary embodiment, transfer nip roll 105 may be connected to a power supply. In such an embodiment, transfer roll 105 may be an electrostatic charge roll that may maintain an electrostatic field which would then attract the charged toner particles toward the media surface. The net downward force applied to the toner particles, which may be combined with pressure applied to the toner and media, effects transfer of toner particles from the photoreceptor 104 to the media sheet 114.

Although the embodiment of FIG. 1 shows the media transfer assembly 103 as including the transfer belt 112, it is envisioned that any device capable of transferring a media, such as, for example, a drum or other device, may be implemented.

Figure 2:
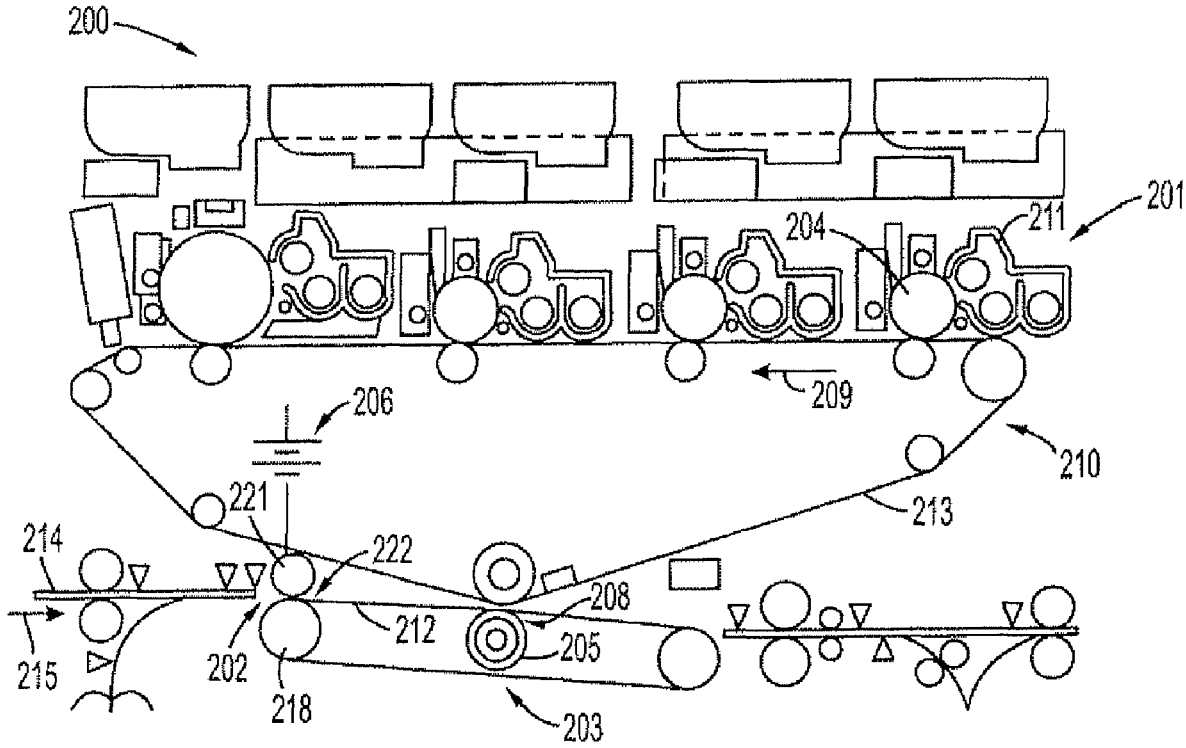
FIG. 2 is a front view of an imaging device of an exemplary embodiment.

FIG. 2 shows an embodiment of an image transfer apparatus 200 wherein one or more image formation assemblies 201 may be in operative contact with an intermediate transfer assembly 210 whereby a single color image may be transferred from a photoreceptor 204 capable of receiving a latent image to an intermediate belt 213 of the intermediate transfer assembly 210, which is disposed remotely from the photoreceptor 204. The photoreceptor 204 may be mounted rotatably on an axis that provides rotation along the direction of arrow 209. Charged toner particles may be deposited by a development assembly 211 in a charged area of the image on the photoreceptor 204 to define a visible toner image that corresponds to the latent image. The toner image on the photoreceptor is then transferred to the surface of the intermediate belt 213. The built-up toner image may then be carried by the intermediate belt 213 to a transfer nip 208. The transfer nip 208 may be defined by the transfer nip roll 205 at the intermediate belt 213. A toner image may be transferred from the intermediate belt 213 to a sheet 214 which is transported by transfer belt 212 by virtue of pressure and a tailored electrostatic field at transfer nip 208. For example, each of the toner image transfer assemblies 201 may each transfer a different color image to the intermediate belt 213 to form a color image. The embodiments are not limited to this specific embodiment. Any device that transfers images from one medium to another may be implemented. Furthermore, this invention to not limited to transferring images between belts. Images may be transferred to paper, rolls, and the like.

The electrostatic field or transfer field at transfer nip 208 may be tailored in accordance with tacking parameters fed forward from a tacking assembly 202 to ensure substantially complete transfer of toner particles. Tacking assembly 202 may include a variable voltage power supply 206, and a bias nip charge roll 221. Media transfer assembly 203, which includes transfer belt 212, may further include one or more transfer rolls 218. Transfer belt 212 may define with charge roll 221 a bias nip 222. The power supply 206 may be operated in constant dynamic current mode to apply a current to bias charge roll 221, to which variable voltage power supply 206 may be connected. The bias nip 222 defined by bias charge roll 221 and transfer belt 212 may accommodate passage of media sheet 214, which is inserted in the direction of arrow 215 and is delivered to bias nip 222. Power supply 206 may be operated in constant dynamic current mode as soon as a lead edge of media sheet 214 arrives or has arrived at bias nip 222. During this period, media sheet 214 and adjacent transfer belt 212 received a net charge density to establish a substantially high electric field, for example, about 20 volts per micrometer, at a point between media sheet 214 and transfer belt 212. This field may result in electrostatic pressure that may attract media sheet 214 to transfer belt 212, effectively tacking the media sheet 214 to transfer belt 212.

FIG. 1 shows that tacking assembly 102 may include a bias nip 122 charge roll 121 and a variable voltage power supply 106. The power supply 106 may be operated in constant dynamic current mode to apply a current to bias charge roll 121, to which variable voltage power supply 106 may be connected. Bias charge roll 121 and transfer belt 112 may define a bias nip 122 wherein media sheet 114 may be inserted and carried via transfer belt 112 to transfer nip 108. The power supply 106 may be operated in constant dynamic current mode as soon as the lead edge of media sheet 114 has arrived at the bias nip 122. As media sheet 114 approaches transfer belt 112 and pass through to enter bias nip 122, media sheet 114 and adjacent belt 112 receive a net charge density to establish a substantially high electric field, for example, about 20 volts per micrometer, at a point between media sheet 114 and transfer belt 112. This field may result in electrostatic pressure that attracts media sheet 114 to belt 112, effectively tacking the media sheet 214 to transfer belt 212. For example, tacking pressures of up to 0.6 psi have been achieved. An alternative tacking assembly may include a corotron device situated above belt 112 in place of the bias nip charge roll 121.

If the tacking assembly 102 has no stored data related to a approaching media type, then a default current set point will be maintained. For example, a 20-32 uA range with corotron tacking an 11" wide media is exemplary, but other set points are possible. If the tacking assembly 102 does have data characterizing the approaching media type, user intervention or data from previous measurements and/or lookup tables may be used to apply a current set point best suited for tacking that particular media type.

The voltage of the power supply can be monitored while the set point current is being delivered, and the voltage level may give the system controller an indication of how much voltage the power supply must supply to deliver the current to media sheet 114 and transfer belt 112. Because the electrical properties of the belt 112 are essentially constant over a short time period, it can be inferred that the differences in power supply voltages are caused by differences in media properties. For example, one such media property is the effective width of the sheet in the cross-process direction. Another such media property is the bulk resistivity of the sheet, which generally can vary as a function of the moisture content of the sheet. The specific differences may be sensed at the bias nip 122 of the tacking assembly 102, in advance of the media sheet 114 lead edge arriving at the toner image transfer assembly 101. It is therefore possible to feedforward the tacking power supply reaction to the media sheet 114 to toner image transfer assembly 101 in order to control the transfer field accordingly.

Figure 3:
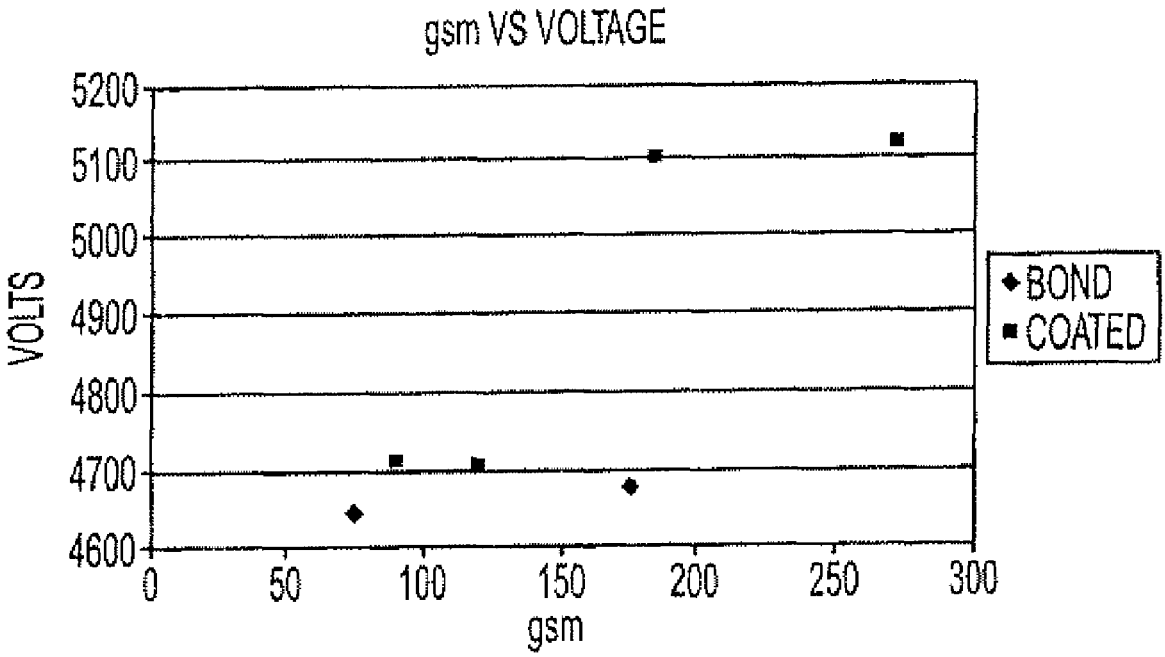
FIG. 3 is a graph depicting grams per square meter of media and required power supply voltage.

With reference to FIG. 3, exemplary data collected across several media types is shown, all at constant tacking current. The graph depicts compensatory voltages required for media types of varying grams per square meter. Also, the graph depicts data relative to both bond media and coated media. The graph clearly indicates the differing dielectric properties of varying media types. In accordance with embodiments discussed herein, and with cross-reference to FIG. 1, this data may be acquired at the tacking assembly 102 as sheet 114 is introduced to bias nip 106 to be carried by transfer belt 112, and fed forward to toner image transfer assembly 101 as transfer belt 112 carries the lead edge of media sheet 114 into transfer nip 108. At this time, toner image transfer assembly 101 will have anticipated the dielectric properties of the approaching media type and adjusted the electric field applied by, e.g., transfer nip roll 105 accordingly.

Figure 4:
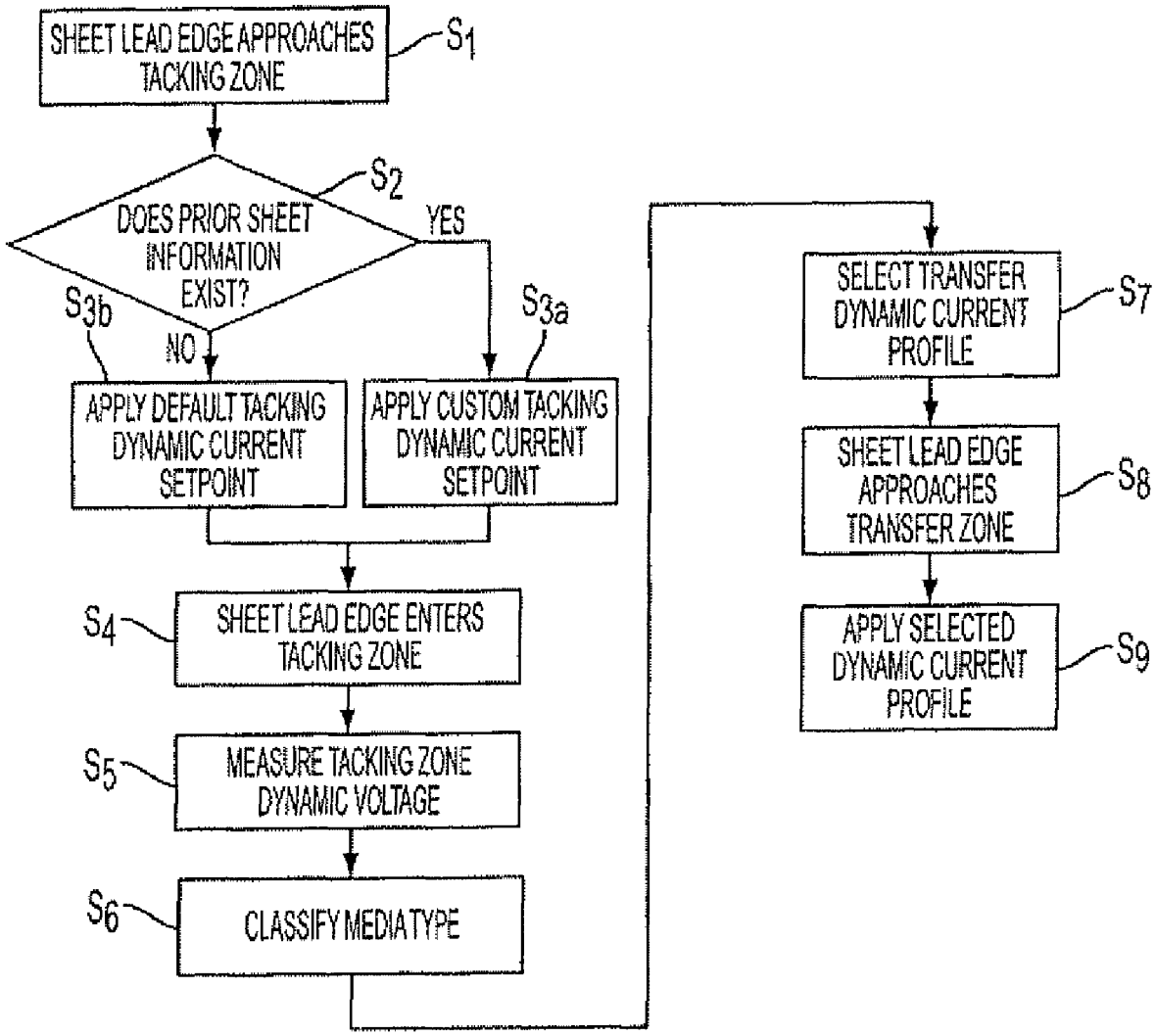
FIG. 4 is a flowchart illustrating a method of feedforward of sheet electrostatic tacking parameters in an exemplary embodiment.

Referring to FIG. 4, a method of toner image transfer is shown. As shown in sheet insertion step S1, media is added to an image transfer apparatus so as to approach a zone of a tacking assembly. As shown in sequential query step S2, the image transfer apparatus determines whether prior sheet information exists. As shown in custom tacking dynamic current set point step S3*a*, a custom tacking dynamic current set point is applied if prior sheet information does indeed exist. In the absence of such prior sheet information, a default tacking dynamic current set point is applied as indicated by default tacking dynamic current set point step S3*b*. In accordance with bias entry nip step S4, the lead edge of the sheet then enters a tacking zone. At this time, a constant dynamic current is applied using a power supply and in accordance with tacking zone measurement step S5, a dynamic voltage required to tack the sheet to a transfer belt is measured. As shown in step S6, the media type is then classified in accordance with the measurement of step S5. In accordance with selection step S7, a transfer dynamic current profile is selected to be applied in optimizing the electrical field applied at the transfer nip of the toner image transfer assembly. As shown in transfer zone approach step S8, the sheet is carried by a transfer belt from the tacking zone to allow the lead edge of the sheet to approach the transfer zone. As indicated by dynamic current profile application step S9, as the sheet approaches and enters the transfer zone, the selected dynamic current profile of selection step S7 is applied.

For purposes of explanation, in the above description, numerous specific details were set forth in order to provide a thorough understanding of the image transfer apparatus, method and system. It will be apparent, however, to one skilled in the art that image transfer as described above can be practiced without the specific details. In other instances, well-known structures and devices are shown in block diagram form in order to avoid obscuring the image transfer method, system and apparatus described.

While image transfer has been described in conjunction with specific embodiments thereof, it is evident that many alternatives, modifications, and variations will be apparent to those skilled in the art. Accordingly, embodiments of the apparatus, method and system as set forth herein are intended to be illustrative, not limiting. There are changes that may be made without departing with the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner image transfer apparatus comprising:

a tacking assembly;

an image transfer assembly constructed to electrostatically transfer an image to a media;

a media transport assembly including a transport device constructed and arranged to accommodate carriage of the media from said tacking assembly to the image transfer assembly, the tacking assembly constructed to electrostatically tack the media to the transport device; and the tacking assembly having a sensing means to sense critical electrical properties of the media, wherein the critical electrical properties are sensed by estimating an electrical state of the media, the estimation performed by measuring a voltage required to tack the media to the transport device.

2. The toner image transfer apparatus of claim 1, the tacking assembly further constructed to sense critical electrical properties of the media during electrostatic tacking.

3. The toner image transfer apparatus of claim 1, wherein the transport device is a belt.

4. The toner image transfer apparatus of claim 1, said tacking assembly further comprising a variable voltage power supply.

5. The toner image transfer apparatus of claim 1, said image transfer assembly includes a photoreceptor.

6. The toner image transfer apparatus of claim 1, the media having a lead edge, the tacking assembly further defining a nip, and the tacking assembly constructed and arranged to sense critical electrical properties of the media as said lead edge enters the nip.

7. The toner image transfer apparatus according to claim 1, wherein said tacking assembly is constructed to generate a signal corresponding to said sensed critical electrical properties, and said image transfer assembly is constructed to receive said signal to affect image transfer.

8. The toner image transfer apparatus according to claim 7, said image transfer assembly further comprising a transfer field, said transfer field being adjustable in accordance with said sensed electrical properties.

9. The toner image transfer apparatus according to claim 1, said image transfer assembly further comprising:

an intermediate transfer assembly for carrying a toner image;

a transfer nip charge roll;

a transfer nip defined by said transfer nip charge roll and an intermediate transfer belt, wherein the intermediate transfer belt carries a toner image for transfer to media at the transfer nip.

10. The toner image transfer apparatus according to claim 9, said image transfer assembly further comprising a photoreceptor wherein said photoreceptor is adapted to carry a latent image.

11. A xerographic device comprising the toner image transfer apparatus of claim 1.

12. A method for toner image transfer using an image transfer apparatus comprising a tacking assembly defining a bias nip and including a power supply, an image transfer assembly defining a transfer nip, and a media transport assembly for carrying media through said bias nip and through said transfer nip, the method comprising:

transporting media to said bias nip;

applying dynamic tacking current to said media in accordance with a current set point;

monitoring voltage of said power supply during said application of tacking current in accordance with the current set point;

determining a difference in the power supply voltage required to maintain a constant tacking current; and feeding forward the determined difference to said image transfer assembly to facilitate an electrical field adjustment at the transfer nip such that optimal toner image transfer is accommodated from said image transfer assembly to said media.

13. The method for toner image transfer of claim 12, said set point being a default set point.

14. The method for toner image transfer of claim 13, said default set point being about 20 μA to about 32 μA.

15. The method for toner image transfer of claim 12, said set point being entered by a user.

16. The method for toner image transfer of claim 12, said set point being based on determinations made for previously tacked media.

17. A non-transitory computer-readable medium on which is recorded a program for implementing the method of claim 12.

18. A system for toner image transfer comprising:

a tacking assembly defining a bias nip for receiving media, the tacking assembly having a power supply, wherein the media is tacked to a transport at the bias nip by applying dynamic current to the media and the transport from the power supply, the tacking assembly constructed to measure critical electrical properties of the media during tacking, wherein the measuring is performed by measuring a voltage required to tack the media to the transport: and an image transfer assembly defining a transfer nip, wherein the image transfer assembly is constructed to receive feedforward measurements from the tacking assembly to facilitate adjustment of an electrical field formed at the transfer nip, wherein optimal toner image transfer may be accomplished.

19. The system for toner image transfer of claim 18, wherein the power supply is a variable voltage power supply from which a constant dynamic current is supplied.

* * * * *